US008531477B2

(12) United States Patent
Jiang et al.

(10) Patent No.: US 8,531,477 B2
(45) Date of Patent: Sep. 10, 2013

(54) DEVICES AND METHODS FOR PROVIDING AN ENHANCED MONOCHROMATIC DISPLAY

(75) Inventors: Simon Jiang, Allen, TX (US); Raymond T. Page, Georgetown, TX (US)

(73) Assignee: ARMSTEL Holding, LLC, Allen, TX (US)

( * ) Notice: Subject to any disclaimer, the term of this patent is extended or adjusted under 35 U.S.C. 154(b) by 145 days.

(21) Appl. No.: 13/334,614

(22) Filed: Dec. 22, 2011

(65) Prior Publication Data

US 2012/0113132 A1 May 10, 2012

Related U.S. Application Data

(63) Continuation-in-part of application No. 12/877,095, filed on Sep. 7, 2010.

(51) Int. Cl.
*G09G 5/02* (2006.01)

(52) U.S. Cl.
USPC ..... 345/605

(58) Field of Classification Search
USPC ..... 345/605
See application file for complete search history.

(56) References Cited

U.S. PATENT DOCUMENTS

| | | | |
|---|---|---|---|
| 7,643,040 | B1 | 1/2010 | Gabrielson et al. |
| 2007/0055143 | A1 | 3/2007 | Deroo et al. |
| 2007/0067124 | A1 | 3/2007 | Kimpe et al. |
| 2007/0211085 | A1 | 9/2007 | Galant |
| 2009/0251483 | A1 | 10/2009 | Hsu et al. |
| 2010/0060660 | A1 | 3/2010 | Bae et al. |

*Primary Examiner* — Aaron M Richer
*Assistant Examiner* — Mohammad H Akhavannik
(74) *Attorney, Agent, or Firm* — Haynes and Boone, LLP

(57) ABSTRACT

A method for grayscale display of a desired output shade comprises transmitting an enhanced grayscale input signal for the desired output shade to an enhanced grayscale engine. The input signal including a plurality of shade bits and a plurality of select bits. The method further comprises decoding the plurality of shade bits and the plurality of select bits to select an intermediate shade from a plurality of intermediate shades. The method further comprises forming an enhanced grayscale display. The method further comprises receiving the enhanced grayscale display signal from the enhanced grayscale engine and displaying an enhanced grayscale image on an output display. Responsive to a first user input, a standard grayscale display signal is selected. The standard grayscale display signal is received and a standard grayscale image is displayed on the output display.

13 Claims, 9 Drawing Sheets

DEVICES AND METHODS FOR PROVIDING AN ENHANCED MONOCHROMATIC DISPLAY

CROSS-REFERENCE TO RELATED APPLICATIONS

This application is a continuation-in-part of U.S. patent application Ser. No. 12/877,095, filed on Sep. 7, 2010, now pending, entitled "ENHANCED MONOCHROMATIC DISPLAY," the entire disclosure of which is incorporated herein by reference thereto.

FIELD

The present disclosure relates generally to the field of human information display and, more particularly, to systems and methods for displaying monochromatic pixel arrays to human users.

BACKGROUND

Modern human society includes a wide variety of environments in which humans must process large amounts of complex information, often under time-sensitive deadlines. Various mechanisms have been developed to collect, synthesize, and convey complex information to humans in a manner that facilitates communication and understanding. For example, color-coding and/or shading have long been an effective mechanism to convey information to improve understanding.

Additionally, certain technological advances have naturally developed shading techniques as an organic aspect of the technology. For example, x-ray images inherently include gradations of shade, which skilled technicians use to gather information relating to medical conditions, material composition, internal construction, and a wide variety of other purposes.

Advances in display technology have allowed for applications that can process x-ray images (and other analog images) as digital images. Such images are often processed as a monochromatic image. However, current display devices that can process these images with the appropriate clarity and precision are often cost prohibitive.

Similarly, common cost-effective display equipment cannot display the number of different monochrome shades necessary to support the proper resolution of the image.

SUMMARY

The following summary is provided to facilitate an understanding of some of the innovative features unique to the embodiments disclosed and is not intended to be a full description. A full appreciation of the various aspects of the embodiments can be gained by taking into consideration the entire specification, claims, drawings, and abstract as a whole.

In one embodiment, a method for grayscale display of a desired output shade comprises transmitting an enhanced grayscale input signal for the desired output shade to an enhanced grayscale engine. The input signal includes a plurality of shade bits and a plurality of select bits. The method further includes decoding the plurality of shade bits and the plurality of select bits to select an intermediate shade from a plurality of intermediate shades. The method further includes setting a plurality of sub-pixel common color bits of a pixel based on the selected intermediate shade. The method further includes setting a plurality of sub-pixel private color bits of the pixel based on the selected intermediate shade. The method further includes setting a plurality of sub-pixel luminosities of the pixel based on the selected intermediate shade. The method further includes forming an enhanced grayscale display signal from the plurality of sub-pixel common color bits, the plurality of private color bits, and the plurality of luminosities of the pixel. The method further includes receiving the enhanced grayscale display signal from the enhanced grayscale engine. The method further includes displaying an enhanced grayscale image based on the enhanced grayscale display signal on an output display. Responsive to a first user input, the method further includes selecting a standard display signal. The method further includes displaying a standard image on the output display.

In another embodiment, a system for generating a desired output shade in a pixel for display to a user comprises a means for transmitting an enhanced grayscale input signal for the desired output shade. The enhanced grayscale input signal includes a plurality of shade bits and a plurality of select bits. The system further includes a means for decoding the plurality of shade bits and the plurality of select bits to select an intermediate shade from a plurality of intermediate shades. The system further includes means for setting a plurality of sub-pixel common color bits of a pixel based on the selected intermediate shade The system further includes means for setting a plurality of sub-pixel private color bits of the pixel based on the selected intermediate shade The system further includes means for setting a plurality of sub-pixel luminosities of the pixel based on the selected intermediate shade. The system further includes means for forming an enhanced grayscale display signal from the plurality of sub-pixel common color bits, the plurality of private color bits, and the plurality of luminosities of the pixel. The system further includes means for selecting between the enhanced grayscale display signal and a standard display signal. The system further includes means for displaying an image associated with the selected display signal.

In another embodiment, a device for displaying a grayscale image to a user comprises an adaptor. The adaptor is configured to receive an input signal, determine whether the received input signal is an enhanced monochromatic input signal or a standard monochromatic input signal, and transmit the received enhanced monochromatic input signal to a grayscale engine. The received input signal includes a plurality of shade bits and a plurality of select bits. The device further includes a grayscale engine configured to decode the plurality of shade bits and the plurality of select bits to select an intermediate shade of a plurality of intermediate shades, set a plurality of sub-pixel common color bits of a pixel based on the selected intermediate shade, set a plurality of private color bits of the pixel based on the selected intermediate shade, and set a plurality of luminosities of the pixel based on the selected intermediate shade. The device further includes an output device configured to receive a standard monochromatic display signal and an enhanced monochromatic display signal including the plurality of sub-pixel common color bits, private color bits, and luminosities of the pixel and to display the pixel to a user. The device further includes a selector device configured to select an output display signal for display on the output device. The output display signal includes at least one of the enhanced monochromatic display signal or the standard monochromatic display signal.

Further aspects, forms, embodiments, objects, features, benefits, and advantages of the present invention shall become apparent from the detailed drawings and descriptions provided herein.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope of the invention. In the following discussion, numerous specific details are set forth to provide a thorough understanding of the present invention. Those skilled in the art will appreciate that the present invention may be practiced without such specific details. In other instances, well-known elements have been illustrated in schematic or block diagram form in order not to obscure the present invention in unnecessary detail. Additionally, for the most part, details concerning network communications, electromagnetic signaling techniques, certain user interface or input/output techniques, and the like, have been omitted inasmuch as such details are not considered necessary to obtain a complete understanding of the present invention, and are considered to be within the understanding of persons of ordinary skill in the relevant art.

As will be appreciated by one skilled in the art, the present invention may be embodied as a system, method, or computer program product. Accordingly, the present invention may take the form of an entirely hardware embodiment, an entirely software embodiment (including firmware, resident software, micro-code, etc.) or an embodiment combining software and hardware aspects, all of which may generally be referred to herein as a "circuit," "module," or "system." Furthermore, the present invention may take the form of a computer program product embodied in any tangible medium of expression having computer usable program code embodied in the medium.

Figure 1:
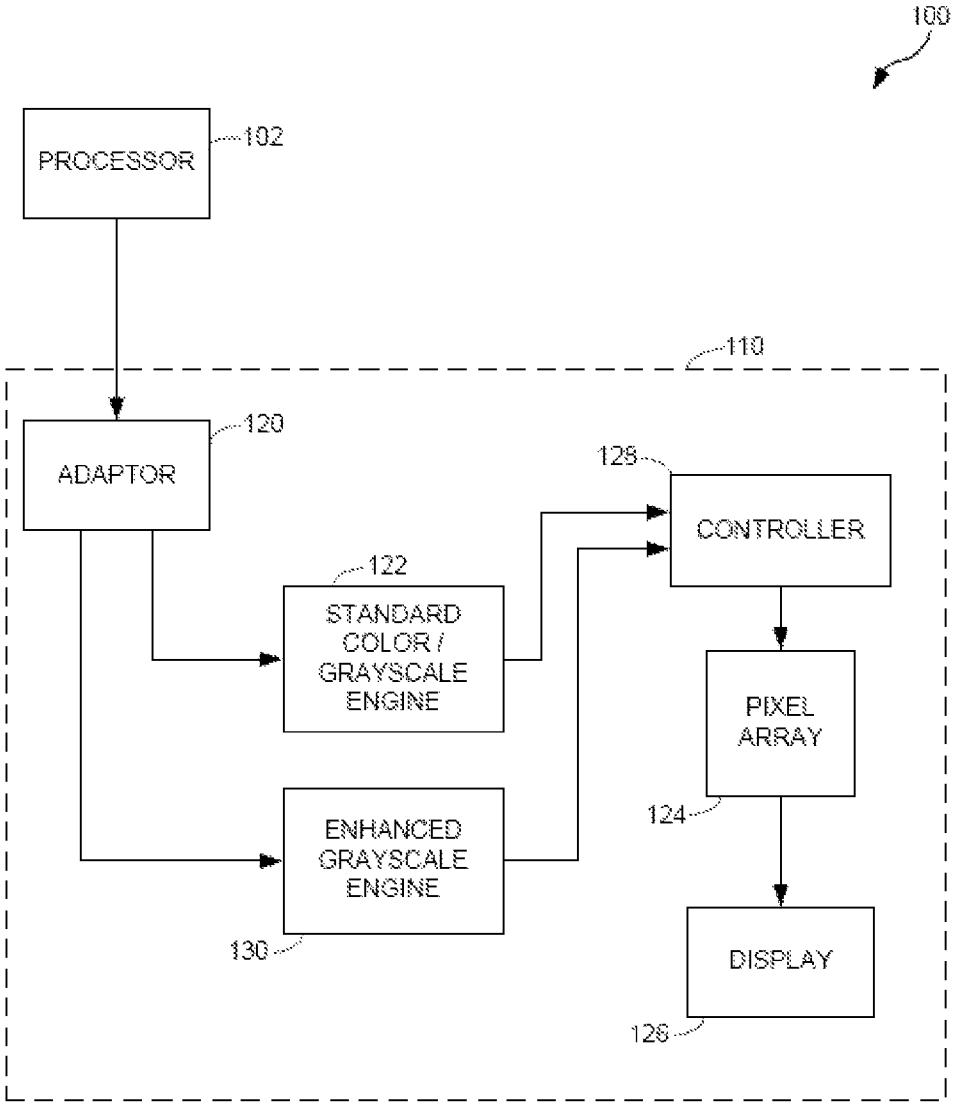
FIG. 1 illustrates a block diagram showing a system for enhanced monochromatic display in accordance with one embodiment of the present disclosure.

FIG. 1 is a high-level block diagram illustrating certain components of a system 100 for enhanced grayscale display. As used herein, "grayscale", means any monochromatic range of shades. For ease of illustration, the disclosed embodiments are described with respect to a gray "grayscale," a range of shades based on a base color of gray. One skilled in the art will understand that the disclosed embodiments can be converted to operate with any base color so as to produce a range of shades in that base color. For example, in one embodiment, a display output is configured as a red grayscale. As such, unless otherwise indicated, "grayscale" and "monochromatic" are used herein substantially interchangeably.

System 100 includes a processor 102 coupled to a display system 110. Generally, processor 102 is an otherwise conventional processor able to run applications and other processes that produce graphical output intended for display to a user. Generally, processor 102 generates signals and/or other communications conveying graphical information, collectively and/or individually, that are intended for use to generate images for display to a user. In one embodiment, processor 102 sends display information configured as conventional input signals able to communicate with an otherwise conventional display device, such as a computer monitor, for example. In one embodiment, as described in more detail below, processor 102 sends display information configured as an enhanced grayscale signal. In one embodiment, processor 102 sends display information configured as an enhanced grayscale signal and/or a conventional input signal.

Generally, in one embodiment, display system 110 receives signals/communications from processor 102, processes the signals, and displays images to a user, as described in more detail below. Display system 110 includes an adaptor 120. Generally, adaptor 120 is an otherwise conventional adaptor able to couple to and communicate with processor 102. In one embodiment, adaptor 120 is also able to identify standard input signals and enhanced grayscale signals. In one embodiment, as described in more detail below, adaptor 120 forwards received signals to one of a variety of components depending on the type of input signal. In one embodiment, adaptor 120 forwards received signals to both a standard display engine and an enhanced grayscale engine.

For example, in the illustrated embodiment, display system 110 includes a standard color/grayscale engine 122 and an enhanced grayscale engine 130. Enhanced grayscale engine 130 couples to adaptor 120 and an array of pixels, as described in more detail below. Generally, standard color/grayscale engine 122 is an otherwise conventional color/grayscale processor able to receive standard input signals and to generate standard display signals based on received standard input signals. In one embodiment, standard display signals are configured to set the bits of a pixel according to common practices.

For example, in the illustrated embodiment, engine 122 couples to a standard 8-bit RGB array 124 through a controller 128. In the illustrated embodiment, controller 128 is configured to select between input from engine 122 and engine 130, and to pass selected input to array 124, as described in more detail below. As described in more detail below, adaptor 120 and/or controller 128, can thereby be configured to display both enhanced grayscale images and standard (color or grayscale) images simultaneously on the same output display.

Generally, array 124 is an otherwise standard array of pixels, modified as described in more detail below. Thus, in the illustrated embodiment, array 124 is able to receive standard display signals from engine 122 and to set the physical elements corresponding to each pixel in the array. In the illustrated embodiment, the physical elements are shown as display 126. That is, in the illustrated embodiment, display 126 is an otherwise conventional array of physical elements configured to operate as pixels.

As such, one skilled in the art will understand that display 126 can be embodied in a variety of configurations. For example, typical modern digital displays now have essentially replaced analog CRT (Cathode-Ray Tube) displays. One skilled in the art will understand that while LCD (Liquid Crystal Display) monitors are the most common digital display technology on the market, but other examples include PDP (Plasma Display Panel), LED (Light Emitting Diodes), OLED (Organic LEDs), DLP (Digital Light Processing), LCoS (Liquid Crystal on Silicon), SED (Surface-conduction electron-Emitter Display), FED, (Field Emission Display), MEMS (Micro-electro-mechanical systems), laser systems, and many others.

Figure 2:
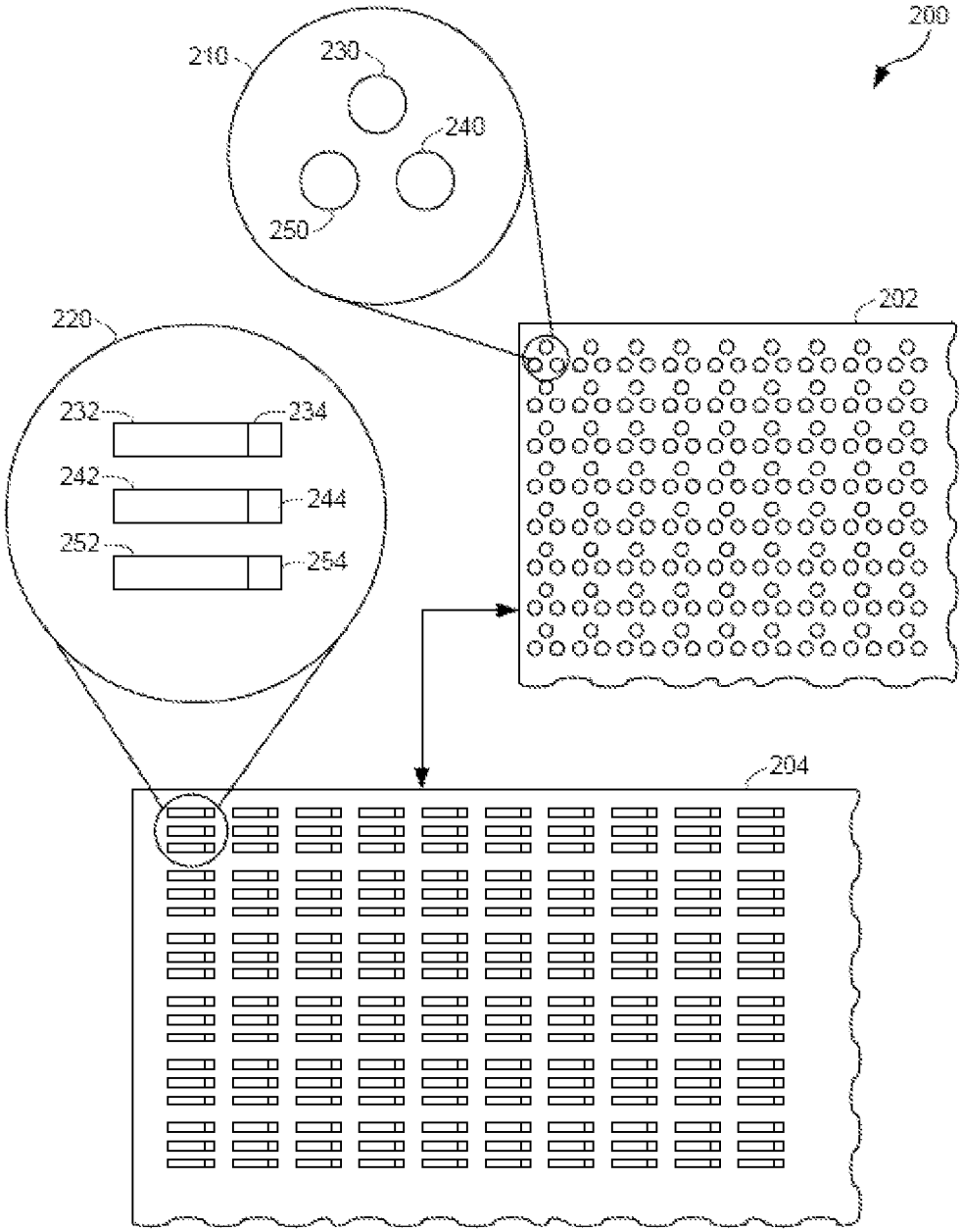
FIG. 2 illustrates a block diagram showing an exemplary pixel array in accordance with one embodiment of the present disclosure.

In one embodiment, regardless of the technology employed to produce light, each pixel in array 124 is comprised of three sub-pixels. For example, FIG. 2 shows an exemplary pixel array and output display in one embodiment. In the illustrated embodiment, system 200 includes an output display 202 coupled to a pixel array 204.

In the illustrated embodiment, output display 202 includes a plurality of physical elements (pixels) 210 arranged in a number of rows and columns. In the illustrated embodiment, each pixel 210 is a tri-color pixel having red, green, and blue sub-pixels. As described in more detail below, in one embodiment pixel 210 is an "RGB pixel." That is, in one embodiment, pixel 210 includes red sub-pixel 230, green sub-pixel 240, and blue sub-pixel 250. In the illustrated embodiment, pixel 210 includes red, green, and blue sub-pixels. One skilled in the art will understand that other suitable sub-pixel configurations can also be employed.

In the illustrated embodiment, output display 202 is in communication with pixel array 204. Generally, in one embodiment, pixel array 204 is configured as a data structure having entries that correspond to the physical pixels of output display 202. For example, in the illustrated embodiment, entry 220 (the top left entry) corresponds to pixel 210 (the top left pixel).

In the illustrated embodiment, entry 220 includes separate fields for each sub-pixel. Additionally, in the illustrated embodiment, each field in entry 220 includes color bits and luminance bits. In one embodiment, as described in more detail below, the color bits include private color bits and common color bits. In the illustrated embodiment, entry 220 includes color bits 232 and luminance bits 234 corresponding to sub-pixel 230; color bits 242 and luminance bits 244 corresponding to sub-pixel 240; and color bits 252 and luminance bits 254 corresponding to subpixel 250. One skilled in the art will understand that the particular values held in entry 220 determine the color/shade of the pixel as seen by the human eye.

That is, if the size and geometry of a tri-color pixel is sufficiently small, the typical human eye can no longer perceive discrete red, green, and blue sub-pixel colors. Instead, the human eye perceives the pixel color as the chromatic sum of the sub-pixels. One skilled in the art will understand that it is this fortunate characteristic of human vision that makes color displays practical. Broadly, display performance is frequently measured by how well the pixels are able to reproduce the color and luminance of the source pixel information, the desired output shade.

Generally, as used herein, "color" means a particular tint or shade. In one embodiment, colors are expressed as a plurality of bits. In one embodiment, colors are expressed as a plurality of bits, partitioned into sub-sections, where each sub-section corresponds to one of an element of a color model, such as RGB, XYZ, HSL/HSV, and/or CMYK, for example. Generally, as used herein, "shade" means a monochrome color tint distinguishable by the human eye from a similar monochrome color tint. In one embodiment, a "shade" is a "just noticeable difference" of one monochrome color tint to a nearby monochrome color tint.

As such, one skilled in the art will understand that, in one embodiment, output display 202 is a two-dimensional array of RGB pixels, forming the basic structure of a color display. In one embodiment, the complete arrangement of physical pixels, and/or their corresponding array entries, is referred to as a "frame". One skilled in the art will understand that typical digital displays can present a new frame of pixel information sixty times per second (60 Hz). A 60 Hz frame-rate is well above the frequency required to give the illusion of continuous motion to the human eye. For instance, the 35 mm projectors used in typical motion picture theaters have a frame-rate of only 24 Hz.

Generally, output display 202, as well as many conventional digital displays, is configured to receive pixel information in a binary format that is discrete in both time and amplitude. One skilled in the art will understand that digital transmission systems are typically able to deliver information noise-free without information loss. However, in some cases, the nature of conveying pixel information via ordinary digital transportation requires the pixel values to be quantized. Accordingly, in many systems, there are a finite number of discrete configurations (color and luminance) available for each sub-pixel color.

In one embodiment, in a configuration for standard display, pixel 210 is an 8-bit-per-channel RGB pixel. In one embodiment, entry 220 assigns 8 bits (entries 232, 234) red sub-pixel 230, assigns 8 bits (entries 242, 244) to green subpixel 240, and assigns 8 bits (entries 252, 254) to blue sub-pixel 250. So configured, display 202 is a "24-bit display," with red, green and blue sub-pixels that can produce 256 luminance steps each, with digital values in the range of 0 to 255. Generally, in one embodiment, display 202 energizes (or otherwise engages) the physical pixels 210 according to the values assigned in array 204. As described in more detail below, one skilled in the art will understand that typical 8-bit-per-channel RBG displays can only generate 256 grayscale shades for monochrome images.

Figure 3:
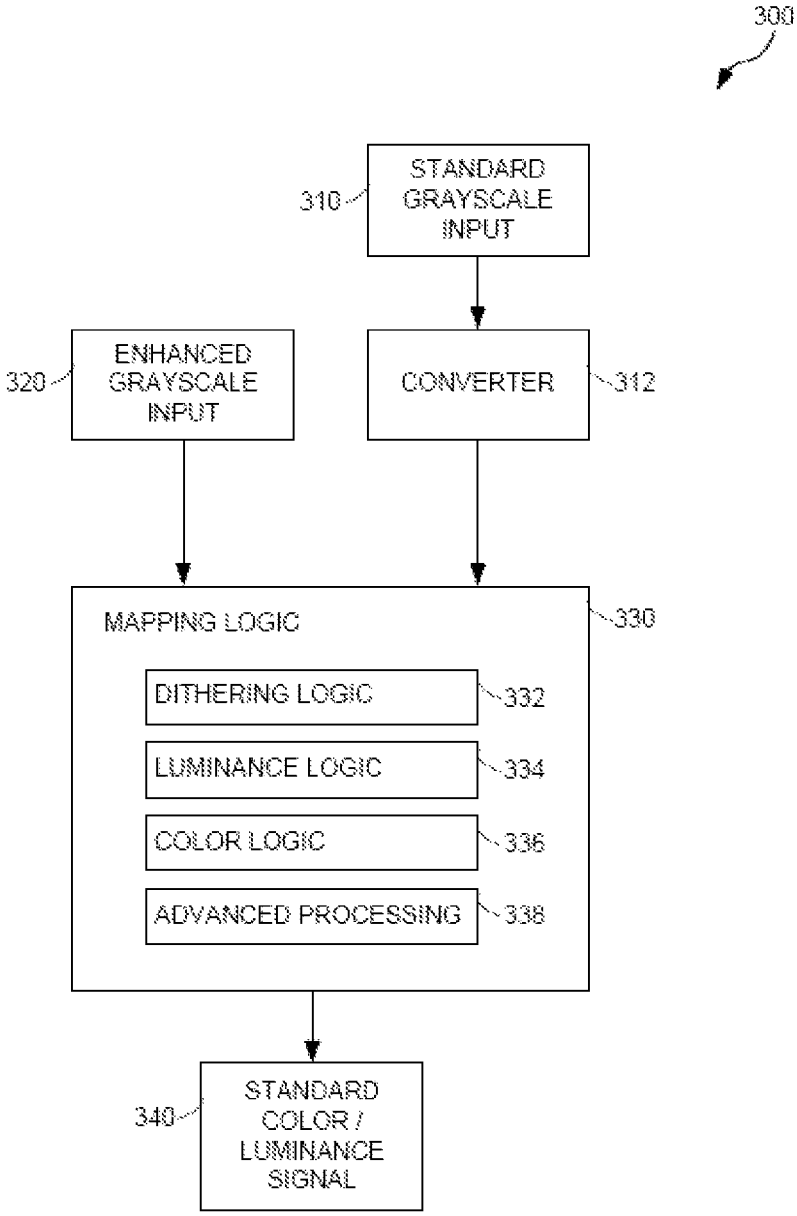
FIG. 3 illustrates a block diagram showing a system for enhanced monochromatic display in accordance with one embodiment of the present disclosure.

FIG. 3 illustrates a system 300 for providing the values in array 204. In one embodiment, system 300 is an enhanced grayscale engine 130 of FIG. 1. In an alternate embodiment, system 300 can be adapted to operate in a variety of environments, as one skilled in the art will understand. Broadly, in one embodiment, as described in more detail below, a mapping logic 330 generates a standard-format color/luminance signal 340 based on received input. In the illustrated embodiment, system 300 includes a converter 312 configured to receive standard grayscale input 310.

Generally, standard grayscale input 310 is configured to generate output signals that employ variations in luminance to provide a limited range of monochromatic shades. Generally, luminance is an indicator of how bright an object appears to a human observer, independent of its color. As described in more detail below, converter 312 is configured to convert standard grayscale input 310 into enhanced grayscale input 320. Generally, enhanced grayscale input 320 is configured to describe an enhanced range of monochromatic shades.

As described in more detail below, in one embodiment, mapping logic 330 receives enhanced grayscale input 320 (and/or standard grayscale input 310 converted to enhanced grayscale input by converter 312) and generates an output signal based on the received input. Specifically, in one embodiment, mapping logic generates standard color/luminance signal 340. In one embodiment, signal 340 is configured to convey display information to a standard display.

For example, as described above, in one embodiment, display 202 receives input from array 204. In one embodiment, signal 340 is configured to set the entries of array 204. In an alternate embodiment, signal 340 is configured for display 202 to receive directly.

Generally, in one embodiment, mapping logic 330 includes dithering logic 332, luminance logic 334, color logic 336, and advanced processing logic 338. As described in more detail below, in one embodiment, each logic module performs particular functions that contribute to the presentation of an enhanced grayscale image on a standard-format output device.

In the illustrated embodiment, mapping logic 330 includes dithering logic 332. Generally, dithering logic 332 is configured to determine appropriate intermediate shades based on the desired output shade indicated in the enhance grayscale input. One skilled in the art will understand that dithering is a well-known and practiced method of extending the perceived color depth of a given digital RGB display interface, by leveraging human vision to average the pixel values over multiple frames. For example, one skilled in the art will understand that, generally, doubling the number of averaged frames doubles the color depth, which thereby doubles the available shades that can be displayed. Additionally, in one embodiment, dithering logic 332 limits dithering to two-frame averaging. So configured, the resultant dithered frames are usually undetectable to the typical human observer. In an alternate embodiment, dithering logic 332 is configured to employ a varying number of frames, including and above two-frame dithering.

In an exemplary two-frame dithering embodiment, a given pixel will rapidly alternate between two values (shades) giving the illusion to a human observer of displaying a value (shade) in between the two shades actually displayed. In one embodiment, for a display driven with a frame-rate of 60 Hz, two-frame averaging results in a flicker rate of 30 Hz, which is above the threshold of human vision. However, in some cases, extending dithering to four-frame averaging yields a 15 Hz flicker rate, which can be detected by human observers. As such, in one embodiment, dithering logic 332 limits dithering to two-frame dithering.

In the illustrated embodiment, mapping logic 330 also includes luminance logic 334. Generally, in one embodiment, luminance logic 334 is configured to perform luminance-mixing. One skilled in the art will understand that luminance-mixing the primary colors, red, green and blue in different ratios can produce a large number of perceived colors, where color is defined by a specific pairing of a hue and luminance value. As described above, a color implies the convergence of a specific hue and luminance level. As such, one skilled in the art will understand that any arbitrary combination of sub-pixel color values results in luminance-mixing of those sub-pixel colors, yielding a specific perceived hue and luminance. Generally, in one embodiment, the number of possible luminance steps (and therefore perceived colors) is constrained by the number of digital bits assigned to each sub-pixel color.

Additionally, human vision limitations also tend to constrain the operational parameters of display systems in general. For example, for humans with normal color vision to perceive a shade of gray, the RGB luminance ratio must be very close to $L_R=0.30L_T$, $L_G=0.59L_T$, and $L_B=0.11L_T$, where $L_T$ is total luminance and $L_{R,G,B}$ is the luminance of each respective primary color (or subpixel). In some systems, the above ratio is referred to as "white balance."

One skilled in the art will understand that some conventional digital displays are configured with a fixed "white balance" ratio in order to simplify interfacing to the external world. For example, driving a conventional 8-bit-perchannel tri-color display (with a fixed white balance), with identical R, G, and B digital values produces a (gray) grayscale pixel, because the display automatically applies the primary color luminance weighting described above. As such, the number of grayscale shades available to conventional displays is limited to 256, effectively making the conventional display an 8-bit grayscale display (when driven with conventional 8-bit RGB channels). As described in more detail below, the disclosed embodiments extend the available grayscale shades of a conventional 8-bit display to the equivalent of an 11-bit grayscale display, without requiring hardware modifications of the conventional display.

In the illustrated embodiment, mapping logic 330 also includes color logic 336. Generally, in one embodiment, color logic 336 is configured to identify and process color information as encoded in the enhanced grayscale input. In one embodiment, as described in more detail below, color logic 336 is configured to select an output color from a plurality of colors based on the enhanced grayscale input. In one embodiment, described in more detail below, color logic 336 is configured to select an output color based on a plurality of bits of the enhanced grayscale input. Generally, in one embodiment, color logic 336 identifies the desired output color/shade indicated in the enhanced grayscale input while dithering logic 332 selects appropriate intermediate shades to produce the desired output color/shade.

In the illustrated embodiment, mapping logic 330 also includes advanced processing module 338. Generally, advanced processing module 338 is configured to perform various post processing and display enhancement techniques. In one embodiment, advanced processing module 338 is configured to perform decode verification. For example, in one embodiment, advanced processing module 338 is configured to store a pixel history and to perform verification on the pixel history to identify standard input and/or enhanced grayscale inputs that have been misidentified.

As described above, mapping logic 330 generates a standard color/luminance signal 340 based on the received enhanced grayscale input. In one embodiment, signal 340 is configured to conform to the input signal requirements of a standard output device. In one embodiment, signal 340 is configured to conform to the input signal requirements of a standard 8-bit-per-channel RGB display.

One skilled in the art will understand that conventional color displays typically rely on the chromatic and temporal characteristics of human vision to create in a display the illusion of a large range of colors and fluid motion. Generally, one skilled in the art will understand that humans have much higher spatial luminance (brightness) resolution than spatial color resolution. This feature of human vision is well known and has been leveraged in broadcast television for the purpose of limiting the bandwidth needed to transmit and store video. For example, conventional DVDs are typically encoded in such a way that adjacent pixels share the same color, but have distinct luminance values. However, conventional methods are subject to significant drawbacks, which are overcome by the disclosed embodiments.

Figure 4:
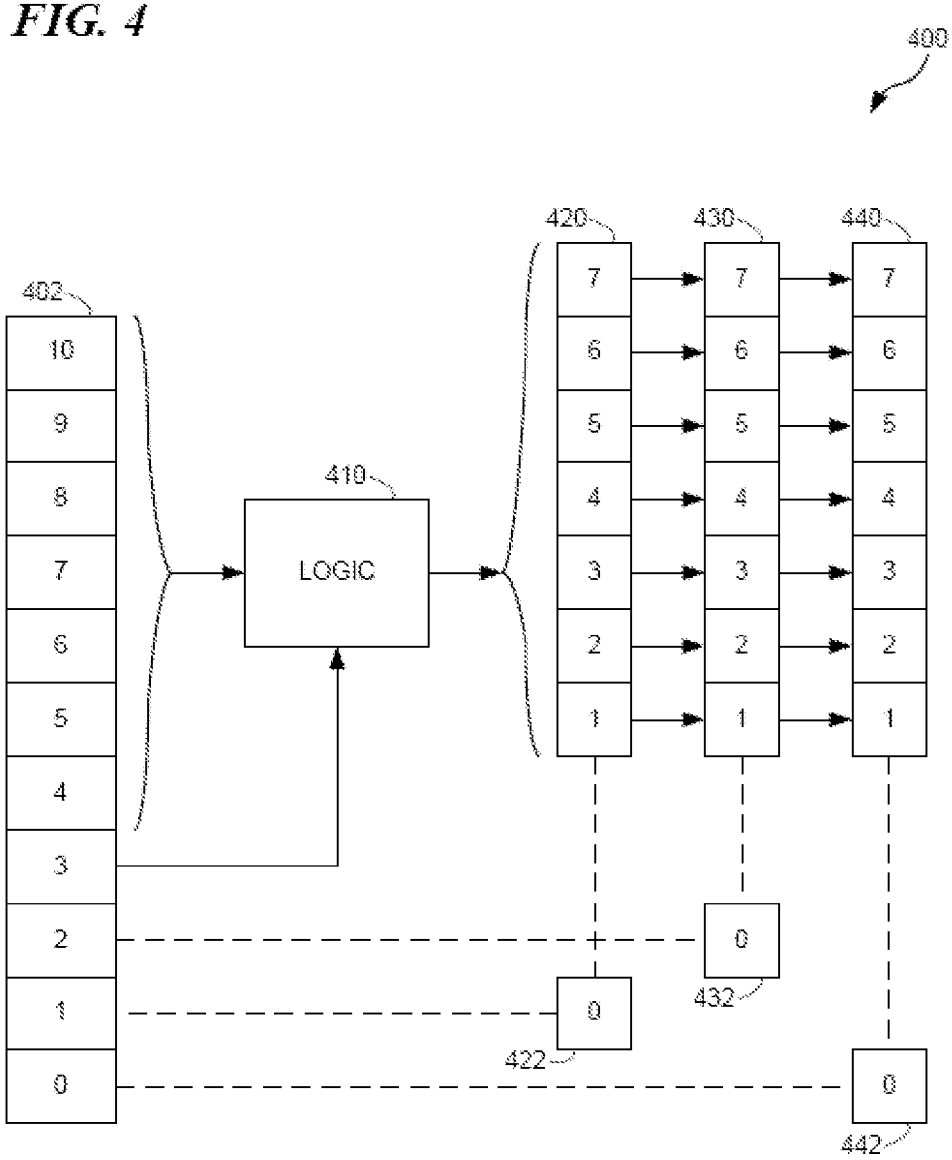
FIG. 4 illustrates a block diagram showing a portion of a grayscale engine in accordance with one embodiment of the present disclosure.

Specifically, in one embodiment, system 300 processes received enhanced grayscale input as described in more detail with respect to FIG. 4. Generally, FIG. 4 illustrates an exemplary bit mapping as processed by mapping logic 330 of FIG. 3. Broadly, system 400 illustrates a mapping of enhanced grayscale input 402 to sub-pixel array entries 420, 430, and 440, as described in more detail below.

Very broadly, in one embodiment, system 400 illustrates a combined Least-Significant Bit (LSB) demultiplexing and dithering to extend the grayscale of a given digital display by a factor of eight. In one embodiment, the luminance contributed by each of the RGB sub-pixel colors follows an approximately binary trend ($L_G \sim 2L_R$ and $L_R \sim 2L_B$). In one embodiment, system 400 assumes a linear luminance transfer function, wherein input pixel data values are directly proportional to the luminance of the respective pixels. In one embodiment, luminance is also normalized to the binary data value.

In the illustrated embodiment, input 402 includes 11 bits. In one embodiment, bits 0-2 and 4-10 are "shade bits" and bit 3 is a "select bit". In one embodiment, bits 0-2 and 4-10 are "shade bits" and bit 3 is both a "shade bit" and a "select bit". In one embodiment, bits 0-2 are "shade bits" contributing to luminance, bits 4-10 are "shade bits", and bit 3 is a "select bit". In one embodiment, bits 0-2 and 4-10 are "direct shade bits," mapped to a particular sub-pixel bit, and bit 3 is an indirect "shade bit," which influences the sub-pixel bits based on bits 4-10. So configured, the disclosed embodiments can, in one embodiment, synthesize 2048 monochrome shades (equivalent to 11-bit grayscale) on a standard 8-bit-perchannel RGB display, as described in more detail below.

In the illustrated embodiment, system 400 includes three sub-pixels 420, 430, and 440. Generally, in one embodiment, sub-pixels 420, 430, and 440 together correspond to entries 220 as described above. In one embodiment, each sub-pixel 420, 430, and 440 includes a plurality of common color bits and a plurality of private color bits. In the illustrated embodiment, each sub-pixel 420, 430, and 440 includes seven common color bits (bits 1-7) and one private color bit (bit 0). Generally, each sub-pixel can be configured with a variety of numbers of common color bits and/or private bits. Generally, however, one skilled in the art will understand that typical 8-bit-per-channel RGB displays are configured with 8-bit entries for each RGB sub-pixel. As such, in one embodiment, sub-pixels 420, 430, and 440 are configured to correspond to conventional RGB channels.

In the illustrated embodiment, system 400 maps the top (higher-order) seven bits of the RBG sub-pixels 430, 430, and 440 to the same value, based on the top seven bits (bits 4-10) of input 402. Additionally, in the illustrated embodiment, system 400 maps bits 0-2, individually, to each of the private color bits of the subpixels. Specifically, in the illustrated embodiment, system 400 maps bit 1 to bit 0 (422) of sub-pixel 420, bit 2 to bit 0 (432) of sub-pixel 430, and bit 0 to bit 0 (442) of sub-pixel 440. Additionally, in one embodiment, system 400 maps bits 0-2 to the low order bits of the sub-pixels according to their luminance significance.

In the illustrated embodiment, system 400 employs bit 3 as a "select bit", which is an input to logic 410. As illustrated, system 400 also provides the upper seven bits of input 402 (the "shade bits") as an input to logic 410. As described in more detail below, in one embodiment logic 410 employs the shade bits and the select bit to configure the common color bits of sub-pixels 420, 430, and 440.

For example, in one embodiment, as described above, system 400 employs two-frame dithering and uses the select bit (bit 3) to select between two intermediate shades. For example, in one embodiment, when bit 3=0, logic 410 copies the values of bits 4-10 to the common color bits of the sub-pixels. Similarly, in one embodiment, when bit 3=1, logic 410 copies the values of bits 4-10 to the common color bits for even-numbered frames. In one embodiment, when bit 3=1, logic 410 copies the values of bits 4-10, plus 1, to the common color bits for odd-numbered frames. Thus, in one embodiment, system 400 can be configured to fit an 11-bit value of pixel information into three 8-bit sub pixels. Thus, the disclosed embodiments can therefore present $2^{11}$ different monochrome shades on systems that ordinarily can only display $2^8$ different monochrome shades using conventional approaches.

One skilled in the art will understand that, in some embodiments, system 400 can yield very slight color shifts. However, in such embodiments, these color shifts will be masked by complimentary color shifts of nearby pixels, leaving only the differences in luminance perceptible. As such, in some embodiments, the disclosed embodiments realize enhanced grayscale images without additional processing to neutralize color shifts through the use of nearby pixels. In such cases, generally, unintended color shifts are so small as to be nearly invisible to normal human vision. Additionally, as described above, in some embodiments, advanced processing module 338 can be configured to normalize and or otherwise process the resultant output shades to improve performance, visibility, and/or other suitable characteristics of the output displayed to the user.

Figure 5:
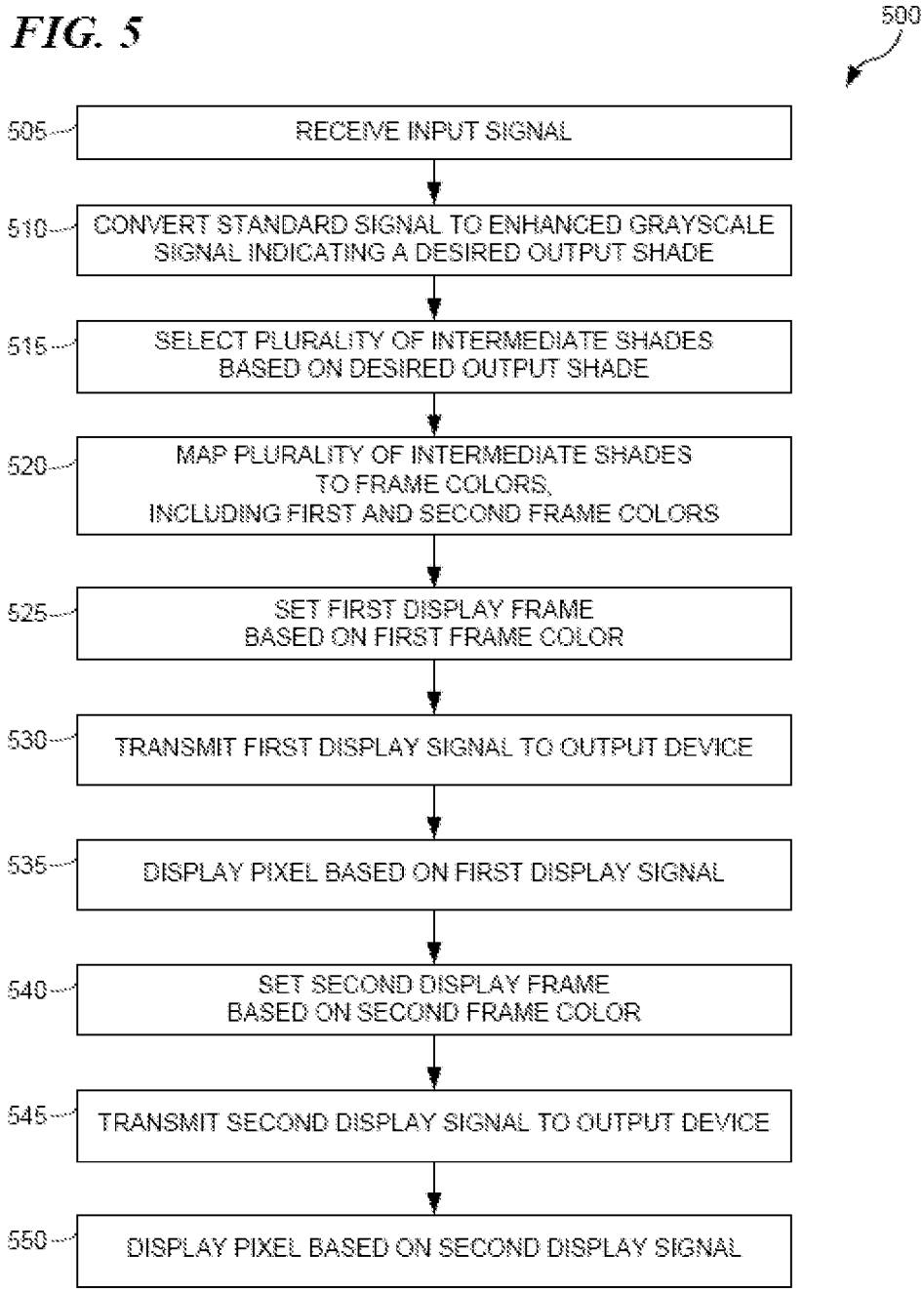
FIG. 5 illustrates a high-level flow diagram depicting logical operational steps of an enhanced grayscale display method, which can be implemented in accordance with one embodiment of the present disclosure.

FIG. 5 illustrates one embodiment of a method for enhanced monochromatic display. Specifically, FIG. 5 illustrates a high-level flow chart 500 that depicts logical operational steps performed by, for example, system 300 of FIG. 3, and/or system 400 of FIG. 4, which may be implemented in accordance with a preferred embodiment. Generally, mapping module 330 performs the steps of the method, unless indicated otherwise.

As indicated at block 505, the process begins, wherein system 300 receives an input signal. Next, as indicated at block 510, converter 312 converts a received standard input signal into an enhanced grayscale signal that indicates a desired output shade. Next, as indicated at block 515, mapping logic 330 selects a plurality of intermediate shades based on the desired output shade.

Next, as indicated at block 520, mapping logic 330 maps the plurality of intermediate shades to frame colors, including first and second frame colors. Next, as indicated at block 525, mapping logic 330 sets a first display frame based on the first frame color. Next, as indicated at block 530, mapping logic 330 transmits a first display signal to an output device. Next, as indicated at block 535, the output device displays the pixel to a user, based on the first display frame.

Next, as indicated at block 540, mapping logic 330 sets a second display frame based on the second frame color. Next, as indicated at block 545, mapping logic 330 transmits a second display signal to the output device. Next, as indicated at block 550, the output device displays the pixel to a user, based on the second display frame, and the process ends.

Figure 6:
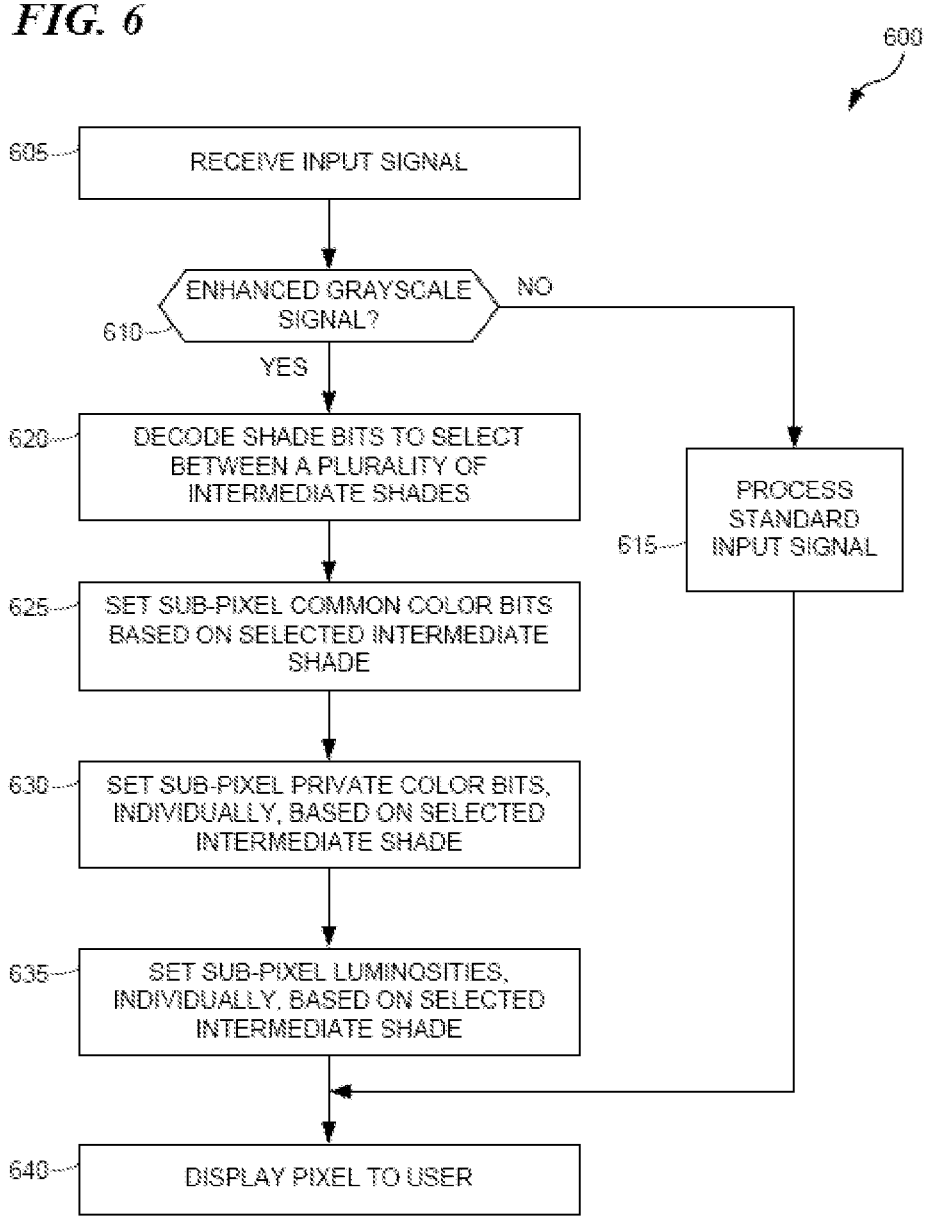
FIG. 6 illustrates a high-level flow diagram depicting logical operational steps of another enhanced grayscale display method, which can be implemented in accordance with one embodiment of the present disclosure.

FIG. 6 illustrates one embodiment of a method for enhanced monochromatic display. Specifically, FIG. 6 illustrates a high-level flow chart 600 that depicts logical operational steps performed by, for example, system 100 of FIG. 1, system 300 of FIG. 3, and/or system 400 of FIG. 4, which may be implemented in accordance with a preferred embodiment. Generally, mapping module 330 performs the steps of the method, unless indicated otherwise.

As indicated at block 605, the process begins, wherein system 300 receives an input signal. Next, as indicated at decisional block 610, the system determines whether the received input signal is an enhanced grayscale signal. For example, in one embodiment, adaptor 120 analyzes the received input signal to determine whether the received input signal is a standard input signal or an enhanced grayscale signal. If at decisional block 610 the input signal is not an enhanced grayscale signal, the process continues along the NO branch to block 615. As illustrated at block 615, system 100 processes the standard input signal normally and the process continues to block 640, wherein system 100 displays the pixel to the user.

If at decisional block 610 the input signal is an enhanced grayscale signal, the process continues along the YES branch to block 620. Next, as indicated at block 620, mapping logic 330 decodes the shade bits of the received input signal to select between a plurality of intermediate shades.

Next, as indicated at block 625, mapping logic 330 sets the sub-pixel common color bits based on the selected intermediate shade. Next, as indicated at block 630, mapping logic 330 sets the sub-pixel private color bits, individually, based on the selected intermediate shade. Next, as indicated at block 635, mapping logic 330 sets the sub-pixel luminosities, individually, based on the selected intermediate shade.

Next, as indicated at block 640, system 100 displays the pixel to the user and the process ends.

System 700 is another system for enhanced monochromatic display that allows a common 8-bit-per-channel display device to display standard color or grayscale images, enhanced grayscale images, or a combination of standard images and enhanced grayscale images in response to a control input. The enhanced grayscale images may conform to Digital Imaging and Communications in Medicine (DICOM) standards which are standards for handling, storing, printing, and transmitting information in medical imaging. The National Electrical Manufacturers Association (NEMA) created the DICOM standard in part to insure that diagnostic images appear the same, whether viewed via print, film, or electronic display. One skilled in the art will understand that DICOM specification (PS 3.14-2009) "Part 14: Grayscale Standard Display Function" recommends that a medical grayscale display produce a minimum of 1024 JND ("Just Noticeable Difference") shades of gray.

System 700 generally includes a computer 702 that operates together with a display system 710 to generate the standard and/or enhanced grayscale images. The computer 702 may be a general-purpose computer such as a desktop, a laptop computer, or a tablet. Computer 702 is able to execute program code, especially program code embodied in a non-transitory medium. In alternative embodiments, the computer may be a special-purpose workstation, thin client, or standard computer running a common operating system such as Windows, Linux, Unix, or Android. The computer 702 includes a processor 704 which may function substantially similar to processor 102 as described above. It also includes connectors 705, 706, 707 for connecting to components of the display system 710. The connectors may be DVI, VGA, DisplayPort, HDMI, USB, serial port, parallel port, wireless, or other suitable peripheral connector. In one embodiment, the display system 710 may, for example, be a 8-bit display system. In an alternative embodiment, the display system may be configured to receive graphic signals of greater than 8 bits, such as 11 bits.

The display system 710 includes an adaptor 720 that is connected to computer 702 via a wired or wireless connection to connector 707. Adaptor 720 manages the communication of signals received from the computer 702 to either or both of a standard color/grayscale engine 722 and an enhanced grayscale engine 724. The display system 710 further includes a selector 732 that receives user input regarding the type of image display desired by the user and a controller 734 that controls which outputs from the engines 722, 724 will be displayed. The display system 710 further includes a pixel array 736 and a display 740 which provide substantially the same structure and functions described above for pixel array 124 and display 126, respectively. A calibration meter 742 may be coupled to the display 740. The enhanced grayscale engine 724 includes an enhanced graphic module 726, a database 728, and a calibration engine 730 that will be described in greater detail below.

The display system 710 receives grayscale input signals from the processor 704, processes the input signals, and displays the images to a user in response to a control input, as described in more detail below. The adaptor 720 may have substantially the same structure and functionality as the adaptor 120 with the additional features and differences described below. The standard color/grayscale engine 722 and enhanced grayscale engine 724 provide substantially the same structure and functions described above for standard color/grayscale engine 122 and enhanced grayscale engine 130, respectively, with the additional features and differences described below. The controller 734 has substantially the same structure and functionality as the controller 128 with the additional features described below.

The selector 732 receives a selection input from a user or other source and provides a control signal to the controller 734 for use in selecting a display input from the standard color/grayscale engine 722 and/or the enhanced grayscale engine 724. In one embodiment, the selector 732 includes a pushbutton located on a computer monitor. When a user pushes the pushbutton, the display 740 switches between displaying an enhanced grayscale image, a standard grayscale image, a combination of the enhanced and standard grayscale images, or no image at all. For example, when the user pushes the pushbutton a first time, the display 740 may display an enhanced grayscale image. The enhanced grayscale image may include an identifier to identify to the user that the displayed image is an enhanced grayscale image. The identifier may be, for example, a logo, an alphanumeric indicator, or an LED indicator on the display 740. When the user pushes the pushbutton a second time, the display 740 may display a standard grayscale image. The standard grayscale image may include an identifier to identify to the user that the displayed image is a standard grayscale image and not an enhanced grayscale image. When the user pushes the pushbutton a third time, the display 740 may display a split screen image displaying a standard grayscale image in one portion of the display and an enhanced grayscale image in another portion of the display. In one embodiment, the default display image on the display 740 when it is initially powered "on" is the standard color/grayscale image. When the default display image is shown on the display 740 and the pushbutton is pushed, the display 740 is switched to an enhanced grayscale image. Alternatively, the default display may be the enhanced grayscale image.

The selector 732 may, alternatively, include other types of discrete input devices for selecting a display input to the controller, such as a thumbwheel switch, a toggle switch, a touch screen, a predetermined series of key strokes, a wireless control switch, or other hardware and software for providing a selection input as is known in the art. The selector 732 may also or alternatively include one or more sensors, such as a motion or optoelectronic sensor, that detect the presence of a user and provide a control input to the controller to select a standard grayscale image input to, for example, reduce power consumption when the presence of a user is not detected. The selector 732 may also or alternatively include one or more timer devices that provide a control input to the controller to select a standard grayscale image input after a predetermined amount of time. The selector 732 may also provide a control signal to the adaptor 720 to control delivery of the signal received from the processor 704 to the grayscale engines 722, 724.

Figure 8:
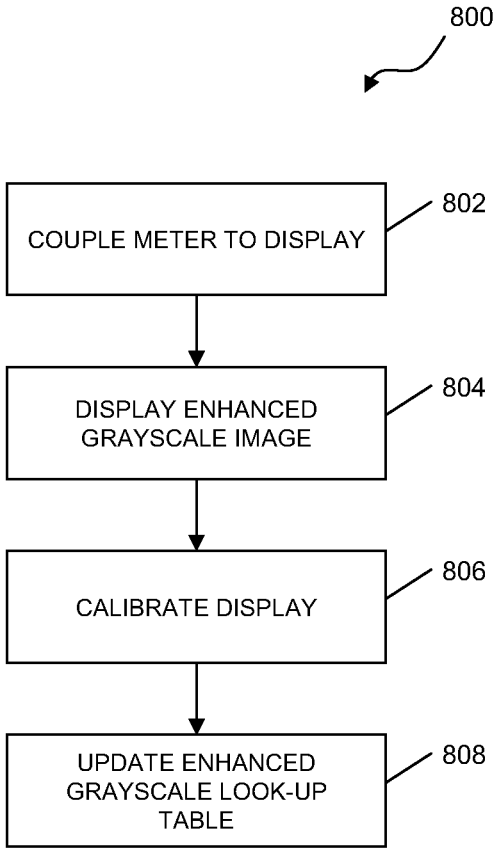
FIG. 8 illustrates a flow diagram depicting a calibration process in accordance with an embodiment of the present disclosure.

Referring now to FIG. 8, upon initial use of the display system 710 and occasionally during subsequent operation, the display system 710 may be calibrated using the procedure 800. The calibration procedure and the components used for calibration are described in further detail in U.S. patent application Ser. No. 13/195,312, entitled "Testing Electronic Displays for Conformity to a Standard" which was filed on Aug. 1, 2011 and which is incorporated by reference herein in its entirety. As an initial step 802, a user attaches the meter 742 to display 740. At step 804, an enhanced grayscale test image based on, for example, a 2048-shade ($2^{11}$ shades) grayscale image is displayed on the display 740.

At step 806, the meter 742 receives emissions from the display 740 and calibrates the display via Window Calispector and calibration engine 730. In one embodiment, the meter 742 includes an array of photodiodes and captures light emissions from the display. The meter 742 generates electronic or optical test data based on the luminosity of the captured light emissions. The test data is sent to the computer 702 for processing. The computer 702, running calibration software, provides instructions to calibration engine 730 to calibrate the display system 710. Specifically, the calibration software determines whether the received collected test data indicates that the test image on the display 742 conforms to a standard. In one embodiment, the standard may be a DICOM standard and the received test luminosity data may be compared to a standardized Grayscale Display Function (GSDF) curve (Barten model) to determine whether the test data conforms to the DICOM standard (Part 14). In alternative embodiments, other standards or calibration analysis techniques may be used.

At step 808, an enhanced grayscale look-up table, which may be stored in database 728, is updated based upon the performed calibration. In one embodiment, for example, 256 ($2^8$) grayscales, out of 2048 ($2^{11}$) shades, are selected from the GSDF Barten model and stored in the display look-up table.

Figure 7:
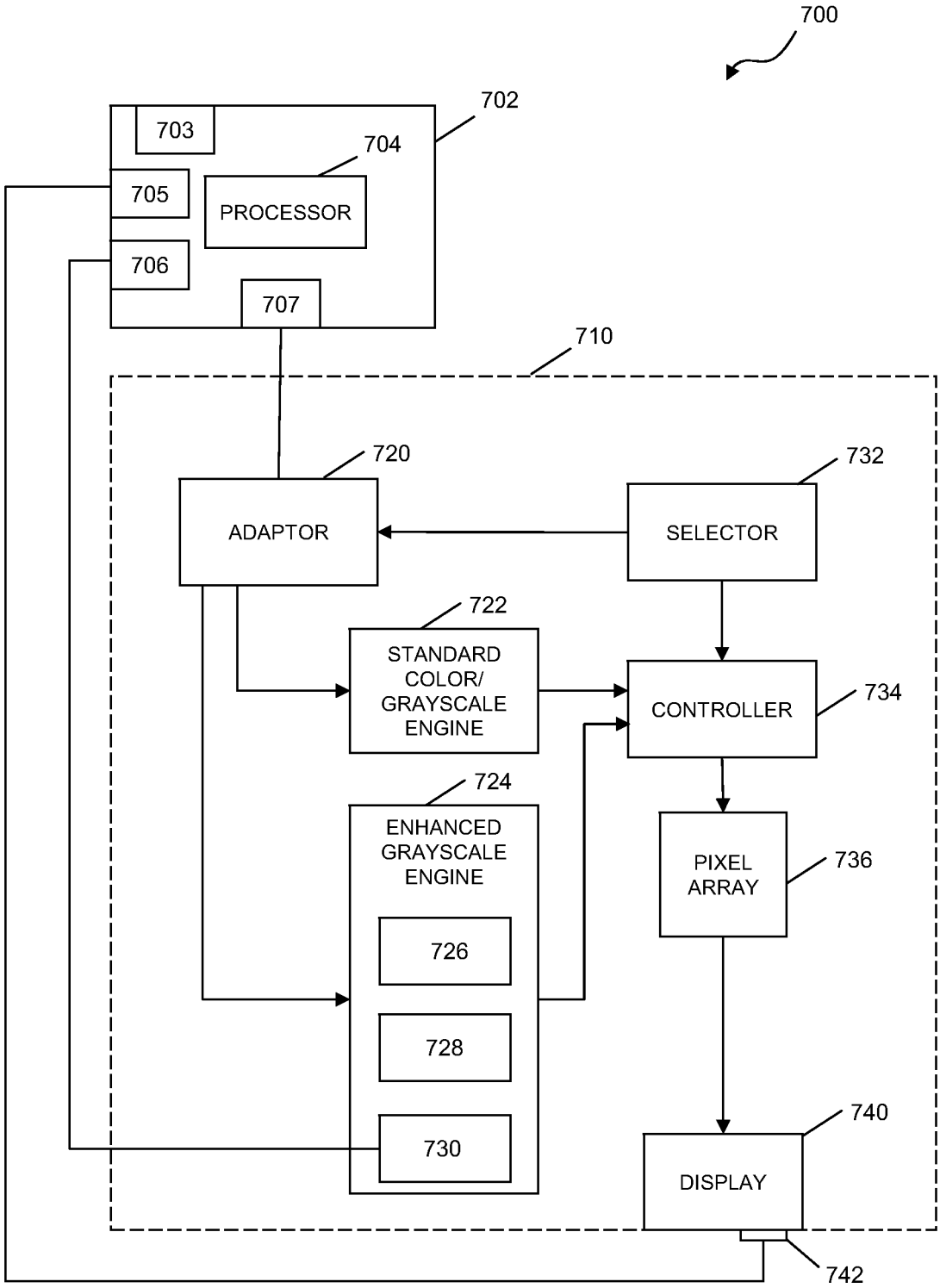
FIG. 7 illustrates a block diagram showing a system for enhanced monochromatic display in accordance with an embodiment of the present disclosure.
Figure 9:
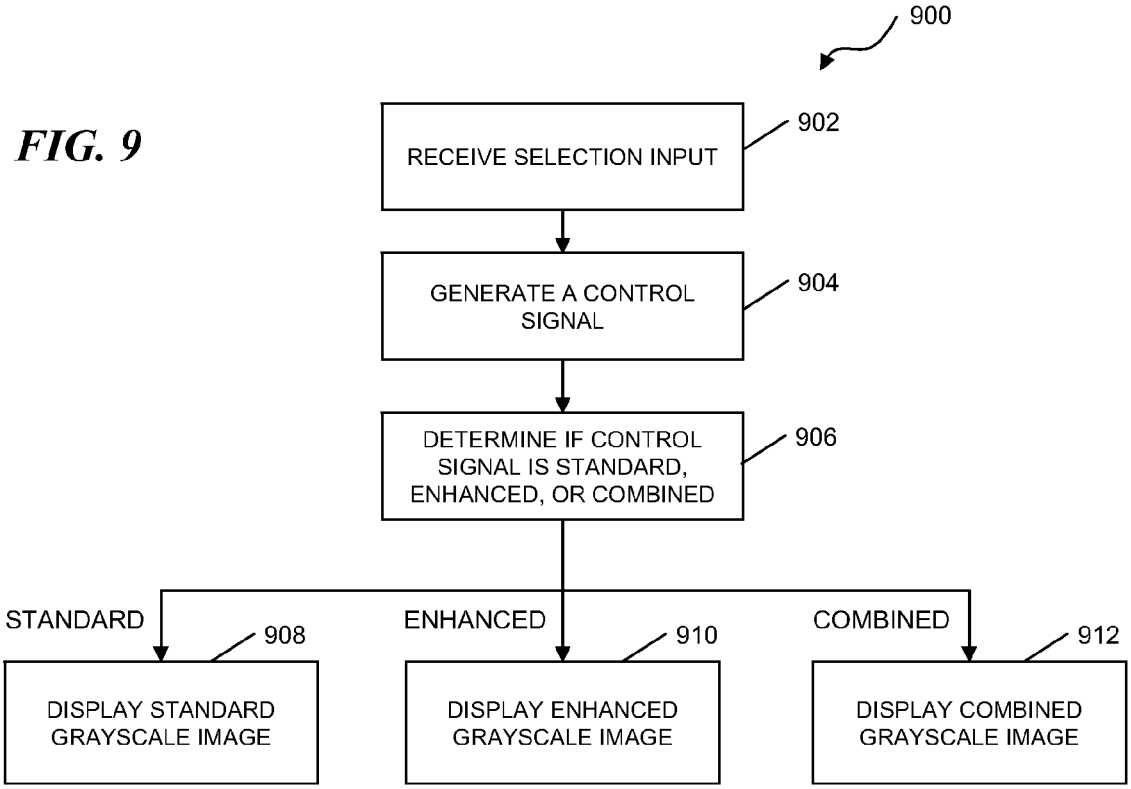
FIG. 9 illustrates a flow diagram depicting logical operational steps for selecting between a standard grayscale display method and an enhanced grayscale display method, which can be implemented in accordance with an embodiment of the present disclosure.

FIG. 9 illustrates one embodiment of a method for monochromatic display. Specifically, FIG. 9 illustrates a flow chart 900 that depicts logical operational steps performed by, for example, system 700 of FIG. 7. Prior to the implementation of the method of flow chart 900, the calibration process of FIG. 8 may be performed.

At block 902 a selection input is received at the selector 732. The selection input may be received, for example, from a user, a sensor, a timer, or other input device. At block 904, the selector 732 generates a control signal corresponding to the selection input and transmits the control signal to the controller 734. The selector 732 also generates an adaptor control signal corresponding to the selection input and transmits that control signal to the adaptor 720.

At block 906, the adaptor 720 and the controller 734 recognize whether the control signals indicate the selection of a standard image, an enhanced image, or a combined image. If, for example, the selector 732 is set to display a standard image, it provides a standard control input to the adaptor 720. Responsive to the standard control input, the adaptor 720 will route the grayscale input signal received from the processor 702 to the standard color grayscale engine 722.

At block 908 the grayscale input signal is received at the standard color/grayscale engine 722. If the signal received from the processor 702 is an 8 bit grayscale input signal, it is routed through the engine 722 which outputs a standard grayscale display signal of 8 bits to the controller 734. In one embodiment, the standard color/grayscale engine 722 generates the 8 bit display signal based upon a standard 256 ($2^8$) 8-bit based grayscale lookup table. Responsive to a control signal received from the selector 732, the controller 734 is set to receive the standard display signal from the engine 722. At block 910, the controller 734 then provides the display signal to the pixel array 724 as previously described.

In an alternative embodiment, the display system may be permitted to receive a signal greater than 8 bits. If the signal received from the processor 702 is an enhanced 11 bit grayscale input signal and the standard image is selected, the grayscale input signal is also routed to through the engine 722 which outputs a standard grayscale display signal of 8 bits to the controller 734. To transform the 11 bit signal to an 8 bit signal, the engine 722 may use the 256 ($2^8$) 8-bit based grayscale lookup table, eliminating the three least significant bits.

Back at block 906, the adaptor 720 and the controller 734 recognize whether the control signals indicate the selection of a standard image, an enhanced image, or a combined image. If, for example, the selector 732 is set to display an enhanced image, it provides an enhanced control input to the adaptor 720. Responsive to the enhanced control input, the adaptor 720 will route the grayscale input signal received from the processor 702 to the enhanced grayscale engine 724.

At block 910, the grayscale input signal is received at the enhanced grayscale engine 724. The engine 724 outputs an enhanced grayscale display signal of 8 bits to the controller 734 by gamma engine 726 based on the calibrated lookup table stored in database 728. In one alternative, the display signal may be generated by referencing the calibrated 11-bit based look-up table stored in the database 728. In another alternative, the display signal may be generated using the enhanced graphics module 726 which operates according to the mapping logic 330 and the bit mapping of system 400 described above. Responsive to a control signal received from the selector 732, the controller 734 is set to receive the enhanced display signal from the engine 724. The controller 734 then provides the display signal to the pixel array 736 as previously described.

In an alternative embodiment, the display system may be permitted to receive a signal greater than 8 bits. If the signal received from the processor 702 is an enhanced 11 bit grayscale input signal and the enhanced image is selected, it is also routed by the adaptor 720 to the enhanced grayscale engine 724 which converts the 11 bit signal to an 8 bit signal using the enhanced graphics module 726 according to the methods described above in FIGS. 3 and 4.

When the selector 732 indicates that a combined image of both standard and enhanced grayscale images is to be displayed, the adaptor 720 will route the input signal from the processor 702 to both grayscale engines 722, 724 and the controller 734 will be set to receive from both engines.

At block 908, 910, and 912, in response to the received control input signal, the controller 734 selects to receive a standard color/grayscale display signal from the standard color/grayscale engine 722, selects to receive an enhanced grayscale display signal from the enhanced grayscale engine 724, or selects to receive both the enhanced and standard display signals from the engines 722, 724 for simultaneous display, respectively. Alternatively, the received control input signal may instruct the controller 734 to sequence to the next display signal in a predetermined order of selected display signals. For example, the predetermined sequence of display signals may be 1) a standard color/grayscale display signal, 2) an enhanced grayscale display signal, and 3) a combined enhanced and standard color/grayscale display signal for simultaneous image display. Alternatively, the received control input signal may instruct the controller 734 to toggle from whichever display signal (standard or enhanced) is currently being displayed on the display device 740 to the other display signal (standard or enhanced), without providing a simultaneous display option.

At block 908, if the display signal selected by the controller 734 is a standard color/grayscale display signal, the array 736 receives the standard color/grayscale display signal and sets the physical elements corresponding to each pixel in the array for display on display device 740. At block 910, if the display signal selected by the controller 734 is an enhanced grayscale display signal, the array 736 receives the enhanced grayscale display signal and sets the physical elements corresponding to each pixel in the array for display on the display device 740. At block 912, if the display signal selected by the controller 734 is a combined enhanced and standard color/grayscale display signal, the array 736 receives the combined signal and sets the physical elements corresponding to each pixel in the array for display on the display device 740. The combined signal may be displayed, for example as a split screen display with an enhanced grayscale image on one portion or the display and a standard color/grayscale image on another portion of the display.

Accordingly, the disclosed embodiments provide numerous advantages over other methods and systems. For example, the disclosed embodiments provide an enhanced grayscale display that leverages the characteristics of human vision to extend the number of perceived shades of monochrome gray that a given digital color display can produce by a factor of eight. For example, in one embodiment, the disclosed embodiments increase number of shades of gray that a standard 8-bit-per-channel tri-color LCD panel can display from 256 (8-bit) to 2048 (11-bit).

Additionally, the disclosed embodiments can be configured to exceed current industry standard display requirements. For example, many physicians use special displays for diagnostic purposes. One such special-purpose display produces grayscale images instead of color for analyzing chest X-Rays, CT scans, and similar high-dynamic-range monochromatic images. One skilled in the art will understand that, in the case of viewing a chest X-Ray, it is important that the X-Ray image viewed on the medical display conveys as much diagnostic information as possible, and at least as much diagnostic information as viewing the X-Ray negative itself against a light-box.

As described above, typical DICOM monitor manufacturers use expensive custom grayscale-only display modules that are capable of generating at least 1024 shades of gray. However, such monitors, known as 10-bit DICOM displays, are typically very costly and nevertheless restrict the maximum number of monochromatic shades to $2^{10}$ (i.e., as per the number of binary bits used to describe the desired output shade). But the disclosed embodiments provide, in one embodiment, a 3-bit extension of the color/shade range without also introducing higher costs, power usage, or requiring a custom display device.

Moreover the disclosed embodiments also offer improvements over conventional dithering techniques. For example, one skilled in the art will understand that conventional dithering techniques are ordinarily limited to two-frame dithering because, as described above, additional frame averaging above two frames causes a flicker rate detectable by a human observer. As such, conventional dithering techniques would limit grayscale enhancement to doubling the shades of gray from 256 to 512 shades in a typical 8-bit-per-channel RGB color display. But the disclosed embodiments can be configured to provide over 2000 monochromatic shades without also requiring more than two-frame dithering. As such, the disclosed embodiments offer greater performance over prior systems and methods.

The disclosed embodiments also provide a single display device that allows a user to select between enhanced and standard color/grayscale image viewing, rather than requiring separate display devices for enhanced grayscale imaging and standard color/grayscale image viewing. In one example, a user may use a single display device for displaying DICOM compliant enhanced grayscale images and, with the use of a selector device, switch to a standard image for performing word processing, internet usage, or other applications that do not demand the power and high luminosity requirements associated with the enhanced grayscale images.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The term "such as," as used herein, is intended to provide a non-limiting list of exemplary possibilities.

While various embodiments of the invention have been described above, it should be understood that they have been presented by way of example only, and not limitation. Where methods and steps described above indicate certain events occurring in certain order, those of ordinary skill in the art having the benefit of this disclosure would recognize that the ordering of certain steps may be modified and that such modifications are in accordance with the variations of the invention. Additionally, certain steps may be performed concurrently in a parallel process when possible, as well as performed sequentially as described above. Thus, the breadth and scope of the invention should not be limited by any of the above-described embodiments, but should be defined only in accordance with the following claims and their equivalents. While the invention has been particularly shown and described with reference to specific embodiments thereof, it will be understood that various changes in form and details may be made.

What is claimed is:

1. A method for grayscale display of a desired output shade comprising:

transmitting an enhanced grayscale input signal for the desired output shade to an enhanced grayscale engine, the input signal including a plurality of shade bits and a plurality of select bits;

decoding the plurality of shade bits and the plurality of select bits to select an intermediate shade from a plurality of intermediate shades;

setting a plurality of sub-pixel common color bits of a pixel based on the selected intermediate shade;

setting a plurality of sub-pixel private color bits of the pixel based on the selected intermediate shade;

setting a plurality of sub-pixel luminosities of the pixel based on the selected intermediate shade;

forming an enhanced grayscale display signal from the plurality of sub-pixel common color bits, the plurality of private color bits, and the plurality of luminosities of the pixel;

receiving the enhanced grayscale display signal from the enhanced grayscale engine;

displaying an enhanced grayscale image based on the enhanced grayscale display signal on a standard Red/Green/Blue color output display, wherein the standard Red/Green/Blue color output display is an n-bit-per-channel Red/Green/Blue color output display;

responsive to a first user input, selecting a standard display signal; and displaying a standard image based on the standard display signal on the output display, wherein the enhanced grayscale input signal for the desired output shade comprises n+3 bits.

2. The method of claim 1 wherein the enhanced grayscale image and the standard image are displayed on the output display at the same time.

3. The method of claim 1 further comprising responsive to the first user input, ceasing display of the enhanced grayscale image on the output display.

4. The method of claim 1 further comprising transmitting a standard input signal for the desired output shade wherein the standard input signal for the desired output shade is 8 bits and the standard display signal is 8 bits per sub-pixel.

5. A system for displaying a grayscale image to a user, the device comprising:

a standard grayscale engine configured to generate a standard grayscale display signal by referencing a first look-up table;

an enhanced grayscale engine configured to generate an enhanced grayscale display signal by referencing a second look-up table;

decoding a plurality of shade bits and a plurality of select bits to select an intermediate shade from a plurality of intermediate shades;

setting a plurality of sub-pixel common color bits of a pixel based on the selected intermediate shade;

setting a plurality of sub-pixel private color bits of the pixel based on the selected intermediate shade;

setting a plurality of sub-pixel luminosities of the pixel based on the selected intermediate shade; and forming the enhanced grayscale display signal from the plurality of sub-pixel common color bits, the plurality of private color bits, and the plurality of luminosities of the pixel;

a selector device configured to receive a user input, generate a control signal associated with the user input, and select at least one of the standard or enhanced grayscale display signals for display;

an adaptor configured to receive an input graphic signal comprising n bits including the plurality of shade bits and the plurality of select bits and, responsive to the control signal, transmit the input graphic signal to a selected one or both of the standard grayscale or enhanced grayscale engine; and a standard Red/Green/Blue color output display device, wherein the standard Red/Green/Blue color output display device is an (n+3)-bit-per-channel Red/Green/Blue color output display, the output display device configured to display an image based upon at least one of the grayscale display signals.

6. The system of claim 5 wherein the display device is configured to display an image based upon both the enhanced grayscale display signal and the standard grayscale display signal at the same time.

7. The system of claim 5 wherein the selector device includes means for ceasing a display of an unselected enhanced grayscale or standard display signal.

8. The system of claim 5 wherein the selector device includes a pushbutton or a software based selector.

9. The system of claim 5 wherein the selector device includes a sensor.

10. The system of claim 5 wherein the selector device includes a timer.

11. The system of claim 5 wherein the selector device includes a wireless switch control.

12. The system of claim 5 further comprising a luminosity meter and wherein the second look-up table is generated by calibration of the display device with the luminosity meter.

13. The system of claim 12 wherein calibration of the display device with the luminosity meter includes a comparison of data received from the luminosity meter to a DICOM Grayscale Display Function Barten model.

* * * * *

UNITED STATES PATENT AND TRADEMARK OFFICE

CERTIFICATE OF CORRECTION

PATENT NO. : 8,531,477 B2
APPLICATION NO. : 13/334614
DATED : September 10, 2013
INVENTOR(S) : Jiang et al.

It is certified that error appears in the above-identified patent and that said Letters Patent is hereby corrected as shown below:

In the Claims:

Column 18, Claim 5, Line 22, delete the portion of text reading "(n+3)" and replace with --(n-3)--.

Signed and Sealed this
Twenty-ninth Day of October, 2013

Teresa Stanek Rea
*Deputy Director of the United States Patent and Trademark Office*